US010006341B2

(12) United States Patent
Annati et al.

(10) Patent No.: US 10,006,341 B2
(45) Date of Patent: Jun. 26, 2018

(54) COMPRESSOR ASSEMBLY HAVING A DIFFUSER RING WITH TABS

(71) Applicant: Caterpillar Inc., Peoria, IL (US)

(72) Inventors: Richard E. Annati, Lafayette, IN (US); Robert C. Lancaster, Indianapolis, IN (US); David R. Adair, Valley Center, CA (US)

(73) Assignee: Caterpillar Inc., Peoria, IL (US)

( * ) Notice: Subject to any disclaimer, the term of this patent is extended or adjusted under 35 U.S.C. 154(b) by 497 days.

(21) Appl. No.: 14/642,323

(22) Filed: Mar. 9, 2015

(65) Prior Publication Data

US 2016/0265373 A1 Sep. 15, 2016

(51) Int. Cl.
*F02B 33/40* (2006.01)
*F01D 25/24* (2006.01)
(Continued)

(52) U.S. Cl.
CPC ..... *F02B 33/40* (2013.01); *F01D 9/048* (2013.01); *F01D 25/246* (2013.01); *F02B 37/00* (2013.01); *F04D 17/06* (2013.01); *F04D 29/284* (2013.01); *F04D 29/441* (2013.01); *F04D 29/444* (2013.01); *F01D 25/243* (2013.01); *F05D 2220/40* (2013.01)

(58) Field of Classification Search
CPC ..... F02B 33/40; F02B 37/00; F04D 29/444; F04D 29/441; F04D 17/06; F04D 29/284; F01D 9/048; F01D 25/246; F01D 25/243
USPC ..... 60/605.1
See application file for complete search history.

(56) References Cited

U.S. PATENT DOCUMENTS 2,373,713 A 4/1945 Shoults
2,918,207 A * 12/1959 Moore ..... F02C 6/12 415/135

(Continued)

FOREIGN PATENT DOCUMENTS

WO WO 2014/038479 A1 3/2014
WO WO 2014/132727 A1 9/2014
WO WO 2014/148274 A1 9/2014

OTHER PUBLICATIONS

U.S. Patent Application of Richard E. Annati et al., entitled "Compressor Assembly Having Dynamic Diffuser Ring Retention" filed Mar. 9, 2015.

(Continued)

*Primary Examiner* — Jason T Newton
(74) *Attorney, Agent, or Firm* — Finnegan, Henderson, Farabow, Garrett & Dunner, LLP

(57) ABSTRACT

A compressor assembly is disclosed. The compressor assembly may have a compressor housing. The compressor assembly may also have a compressor impeller disposed within the compressor housing. Further, the compressor assembly may have a bearing housing attached to the compressor housing. The compressor assembly may also have a diffuser ring disposed between the compressor housing and the bearing housing. In addition, the compressor assembly may have at least one tab. The tab may extend radially outward from the diffuser ring. The tab may be configured to engage with a recess in the compressor housing. The compressor assembly may also have at least one fastener. The fastener may be configured to attach the diffuser ring and the compressor housing.

12 Claims, 8 Drawing Sheets

(51) Int. Cl.

| | |
|---|---|
| ***F04D 29/28*** | (2006.01) |
| ***F02B 37/00*** | (2006.01) |
| ***F01D 9/04*** | (2006.01) |
| ***F04D 17/06*** | (2006.01) |
| ***F04D 29/44*** | (2006.01) |

(56) References Cited

U.S. PATENT DOCUMENTS 3,169,486 A 2/1965 Freed
3,881,841 A 5/1975 Straniti
3,939,651 A 2/1976 Penny
3,957,392 A 5/1976 Blackburn
4,302,150 A 11/1981 Wieland
4,354,802 A 10/1982 Nishida et al.
4,521,151 A 6/1985 Frater et al.
4,579,509 A * 4/1986 Jacobi ..... F01D 17/143 415/199.1
5,145,334 A 9/1992 Gutknecht
5,152,663 A 10/1992 Peroaho et al.
5,253,985 A 10/1993 Ruetz
5,266,002 A * 11/1993 Brasz ..... F04D 29/444 415/208.3
5,299,909 A 4/1994 Wulf
5,445,496 A * 8/1995 Brasz ..... F04D 29/444 415/208.3
5,465,482 A 11/1995 Elvekjaer et al.
5,526,640 A 6/1996 Brooks et al.
5,868,553 A 2/1999 Bättig et al.
5,964,574 A 10/1999 Meier et al.
6,045,266 A 4/2000 Mitsubori et al.
6,120,246 A 9/2000 Auger et al.
6,168,375 B1 * 1/2001 LaRue ..... F04D 25/04 415/146
6,190,123 B1 2/2001 Wunderwald et al.
6,220,234 B1 4/2001 Baker et al.
6,264,429 B1 7/2001 Koeller et al.
6,368,077 B1 4/2002 Meyerkord et al.
6,371,238 B1 4/2002 Svihla
6,478,553 B1 11/2002 Panos et al.
6,499,884 B1 12/2002 Svihla et al.
6,540,480 B2 4/2003 Nikpour
6,629,556 B2 10/2003 Decker et al.
6,663,347 B2 12/2003 Decker et al.
6,669,372 B1 12/2003 Martin
6,709,232 B1 3/2004 Vogiatzis
6,733,236 B2 5/2004 Sumser et al.
6,742,989 B2 6/2004 Osako et al.
6,754,954 B1 6/2004 Decker
6,767,185 B2 7/2004 Martin et al.
6,874,998 B2 4/2005 Roby
6,877,901 B2 4/2005 Wollenweber
6,904,949 B2 6/2005 Decker et al.
6,928,816 B2 * 8/2005 Leavesley ..... F01D 17/14 415/158
6,942,460 B2 9/2005 Osako et al.
6,968,702 B2 11/2005 Child et al.
6,979,172 B1 12/2005 Mackenzie
6,979,183 B2 12/2005 Baumann
6,994,526 B2 2/2006 Furman et al.
7,001,143 B2 2/2006 Vogiatzis
7,001,155 B2 2/2006 Cabrales et al.
7,008,182 B2 * 3/2006 Kopp ..... F01D 9/026 415/136
7,010,915 B2 3/2006 Stilgenbauer
7,040,867 B2 5/2006 Louthan et al.
7,052,241 B2 5/2006 Decker
7,063,508 B2 6/2006 Higashimori et al.
7,066,919 B1 6/2006 Sauerland et al.
7,086,842 B2 8/2006 Wild
7,097,411 B2 8/2006 Smoke et al.
7,104,693 B2 9/2006 Mavrosakis
7,118,335 B2 10/2006 Vacarezza et al.
7,147,433 B2 12/2006 Ghizawi
7,189,059 B2 3/2007 Barton et al.
7,191,519 B2 3/2007 Roby
7,204,671 B2 4/2007 Dellmann
7,214,037 B2 5/2007 Mavrosakis
7,232,258 B2 6/2007 Garcia
7,241,416 B2 7/2007 Sweetland
7,322,805 B2 1/2008 Biver et al.
7,329,048 B2 2/2008 Klusman et al.
7,344,362 B2 3/2008 Kopp et al.
7,384,236 B2 * 6/2008 Meier ..... F01D 25/08 415/178
7,401,980 B2 7/2008 Krauss et al.
7,419,304 B2 9/2008 Mavrosakis
7,461,507 B2 12/2008 Arnold et al.
7,461,979 B2 12/2008 Mavrosakis
7,478,532 B2 1/2009 Martin et al.
7,484,932 B2 2/2009 Aguilar
7,517,154 B2 4/2009 McKeirnan, Jr.
7,524,166 B2 4/2009 Thiele et al.
7,568,883 B2 8/2009 Arnold et al.
7,600,969 B2 10/2009 Frankenstein et al.
7,631,497 B2 12/2009 Panek
7,677,041 B2 3/2010 Woollenweber
7,686,586 B2 3/2010 Nikpour
7,722,336 B2 5/2010 Vaccarezza et al.
7,766,550 B2 8/2010 Larue
7,771,162 B2 8/2010 Castan
7,771,170 B2 8/2010 Seiler
7,793,494 B2 9/2010 Wirth et al.
7,797,936 B2 9/2010 Hayashi et al.
7,798,770 B2 9/2010 Sumser et al.
7,837,448 B2 11/2010 Shimizu et al.
7,845,900 B2 12/2010 Roduner et al.
7,874,136 B2 1/2011 Heyerman
7,878,758 B2 2/2011 Allen et al.
7,918,215 B2 4/2011 Martin et al.
7,946,809 B2 5/2011 Meier et al.
7,987,599 B2 8/2011 Mavrosakis
8,011,885 B2 9/2011 Purdey
8,016,554 B2 9/2011 Ward
8,118,570 B2 2/2012 Meacham et al.
8,122,724 B2 2/2012 Slovisky et al.
8,157,516 B2 4/2012 Chen et al.
8,157,543 B2 4/2012 Shimizu
8,162,602 B2 4/2012 Caucheteux et al.
8,162,604 B2 4/2012 Kühnel et al.
8,166,746 B2 5/2012 Heyerman
8,181,632 B2 5/2012 Ueno et al.
8,186,886 B2 5/2012 McKeirnan, Jr.
8,226,296 B2 7/2012 Larue
8,234,867 B2 8/2012 Palazzolo et al.
8,240,921 B2 8/2012 Böning et al.
8,241,006 B2 8/2012 Renett
8,328,509 B2 12/2012 Gee et al.
8,328,535 B2 * 12/2012 Anschel ..... F04D 29/444 415/208.4
8,339,122 B2 12/2012 Cox et al.
8,348,595 B2 1/2013 Koch et al.
8,353,666 B2 1/2013 Masson et al.
8,360,730 B2 1/2013 Chen et al.
8,372,335 B2 2/2013 Claude et al.
8,376,721 B2 2/2013 Thayer et al.
8,398,363 B2 3/2013 Mundinger et al.
8,419,350 B2 4/2013 Just
8,449,190 B2 5/2013 Larue
8,454,242 B2 6/2013 Mavrosakis
8,464,528 B2 6/2013 Sausse et al.
8,464,777 B2 6/2013 Zhu et al.
8,465,261 B2 6/2013 Holzschuh
8,496,452 B2 7/2013 Marsal et al.
8,517,665 B2 8/2013 Lugo et al.
8,517,679 B2 8/2013 Schlienger et al.
8,545,172 B2 10/2013 Severin et al.
8,568,092 B2 10/2013 Matsuyama
8,572,963 B2 11/2013 Cuniberti et al.
8,602,655 B2 12/2013 Tabata
8,621,863 B2 1/2014 Krätschrner et al.
8,622,691 B2 1/2014 Eguchi et al.
8,628,247 B2 1/2014 Uesugi
8,636,413 B2 1/2014 Fiedler et al.

(56) References Cited

U.S. PATENT DOCUMENTS 8,641,380 B2 2/2014 McKenzie
8,641,382 B2 2/2014 Weber et al.
8,668,432 B2 3/2014 Sebald et al.
8,696,316 B2 4/2014 Decker et al.
8,702,394 B2 4/2014 Decker et al.
8,727,716 B2 5/2014 Clements et al.
8,734,130 B2 5/2014 Meacham et al.
8,736,393 B2 5/2014 Herault et al.
8,740,465 B2 6/2014 McKeirnan, Jr.
8,763,393 B2 7/2014 Severin et al.
8,764,296 B2 7/2014 Omori
8,764,376 B2 7/2014 Lei et al.
8,764,388 B2 * 7/2014 Roberts ..... F01D 17/167 415/158
8,790,066 B2 7/2014 Gutknecht
8,790,574 B2 7/2014 Toda et al.
8,794,905 B2 8/2014 Matsuyama
8,807,840 B2 8/2014 House et al.
8,814,538 B2 8/2014 House et al.
8,834,111 B2 9/2014 Holzschuh
8,834,113 B2 9/2014 Schaus et al.
8,845,271 B2 9/2014 Woollenweber et al.
8,961,128 B2 2/2015 Mavrosakis et al.
2001/0047836 A1 * 12/2001 Welker ..... F15D 1/04 138/39
2005/0123397 A1 * 6/2005 McArdle ..... F01D 17/165 415/196
2007/0196206 A1 * 8/2007 Martin ..... F04D 29/444 415/191
2007/0207030 A1 * 9/2007 Noelle ..... F01D 17/165 415/160
2010/0150709 A1 * 6/2010 Roduner ..... F01D 9/02 415/204
2011/0217162 A1 * 9/2011 Dillon ..... F04D 29/4206 415/207
2013/0170975 A1 * 7/2013 Ishii ..... F01D 9/045 415/208.1
2013/0259661 A1 10/2013 Shudo et al.
2013/0309072 A1 11/2013 Marsal et al.
2014/0093407 A1 4/2014 Calkins et al.
2014/0358363 A1 12/2014 Mavrosakis et al.
2016/0265539 A1 * 9/2016 Annati ..... F04D 17/10
2016/0265549 A1 * 9/2016 Annati ..... F04D 29/441
2016/0265550 A1 * 9/2016 Annati ..... F04D 29/444
2016/0265553 A1 * 9/2016 Annati ..... F04D 29/624
2017/0108003 A1 * 4/2017 Rusch ..... F04D 29/444

OTHER PUBLICATIONS

U.S. Patent Application of Richard E. Annati et al., entitled "Compressor Assembly Having a Vaneless Space" filed Mar. 9, 2015.
U.S. Patent Application of Richard E. Annati et al., entitled "Housing Assembly for a Turbocharger" filed Mar. 9, 2015.
U.S. Patent Application of Richard E. Annati et al., entitled "Compressor Assembly Having a Matched Shim" filed Mar. 9, 2015.

* cited by examiner

COMPRESSOR ASSEMBLY HAVING A DIFFUSER RING WITH TABS

TECHNICAL FIELD

The present disclosure relates generally to a compressor assembly and, more particularly, to a compressor assembly having a diffuser ring with tabs.

BACKGROUND

Internal combustion engines, for example, diesel engines, gasoline engines, or natural gas engines employ turbochargers to deliver compressed air for combustion in the engine. A turbocharger compresses air flowing into the engine, helping to force more air into combustion chambers of the engine. The increased supply of air allows for increased fuel combustion in the combustion chambers, resulting in increased power output from the engine.

A typical turbocharger includes a shaft, a turbine wheel connected to one end of the shaft, a compressor wheel connected to the other end of the shaft, and bearings to support the shaft. Separate housings connected to each other enclose the compressor wheel, the turbine wheel, and the bearings. Exhaust from the engine expands over the turbine wheel and rotates the turbine wheel. The turbine wheel in turn rotates the compressor wheel via the shaft. The compressor wheel receives cool air from the ambient and forces compressed air into combustion chambers of the engine.

The compressor stage of a turbocharger often includes a diffuser configured to reduce the speed of the air leaving the compressor wheel. Reducing the air speed causes the air pressure within the compressor stage to increase, which in turn helps to deliver compressed air to the combustion chambers of the engine. The compressor diffuser usually includes vanes extending between the bearing housing and the compressor housing. These vanes direct the spinning air from the compressor impeller into the compressor housing volute. Because the compressor housing, and the compressor diffuser are usually made of different materials, they expand and contract to different extents, making it difficult to attach the compressor diffuser to the compressor housing.

U.S. Pat. No. 6,168,375 of LaRue et al. that issued on Jan. 2, 2001 ("the '375 patent") discloses a turbocharger having a radial flow compressor with an annular vane diffuser disposed within the compressor housing. The vane diffuser of the '375 patent is positioned within a channel in an axially-facing surface of a compressor housing back plate. The vane diffuser of the '375 patent is also supported at one end by a lip on the back plate and on the other end by a portion of the compressor housing. The '375 patent further discloses that a pin attaches the vane diffuser to the compressor housing back plate. The '375 patent also discloses that the pin prevents the vane diffuser from rotating relative to the back plate.

Although the '375 patent discloses a vane diffuser retained between the compressor housing and a compressor back plate, the disclosed diffuser retention mechanism may still not be optimal. For example, because the diffuser of the '375 patent is radially constrained by the back plate lip and the compressor housing the disclosed diffuser also may not have sufficient room for radial expansion during operation of the turbocharger. As a result, differential expansion between the vane diffuser and the compressor housing and/or the compressor housing back plate may cause damage to the vane diffuser.

The compressor assembly of the present disclosure solves one or more of the problems set forth above and/or other problems of the prior art.

SUMMARY

In one aspect, the present disclosure is directed to a compressor assembly. The compressor assembly may include a compressor housing. The compressor assembly may also include a compressor impeller disposed within the compressor housing. Further, the compressor assembly may include a bearing housing attached to the compressor housing. The compressor assembly may also include a diffuser ring disposed between the compressor housing and the bearing housing. In addition, the compressor assembly may include at least one tab. The tab may extend radially outward from the diffuser ring. The tab may be configured to engage with a recess in the compressor housing. The compressor assembly may also include at least one fastener. The fastener may be configured to attach the diffuser ring and the compressor housing.

In another aspect, the present disclosure is directed to a diffuser ring. The diffuser ring may include a back plate having a generally annular shape disposed around a rotational axis. The back plate may extend from a back plate leading edge to a back plate trailing edge. The diffuser ring may also include a vane extending outward from back plate. Further, the diffuser ring may include at least one tab. The at least one tab may extend radially outward from the back plate In yet another aspect, the present disclosure is directed to a turbocharger. The turbocharger may include a turbine housing. The turbocharger may also include a turbine wheel disposed within the turbine housing and configured to be driven by exhaust received from an engine. Further, the turbocharger may include a compressor housing. The turbocharger may also include a compressor impeller disposed within the compressor housing. The turbocharger may include a shaft connecting the turbine wheel and the compressor impeller. In addition, the turbocharger may include a bearing housing attached to the compressor housing and the turbine housing. The turbocharger may include a diffuser ring disposed between the compressor housing and the bearing housing. The turbocharger may also include at least one tab extending radially outward from the diffuser ring. The at least one tab may be configured to engage with a recess in the compressor housing. Further, the turbocharger may include at least one washer abutting on the bearing housing and the diffuser ring. The turbocharger may also include at least one fastener configured to pass through the at least one washer and attach the diffuser ring and the compressor housing.

DETAILED DESCRIPTION

Figure 1:
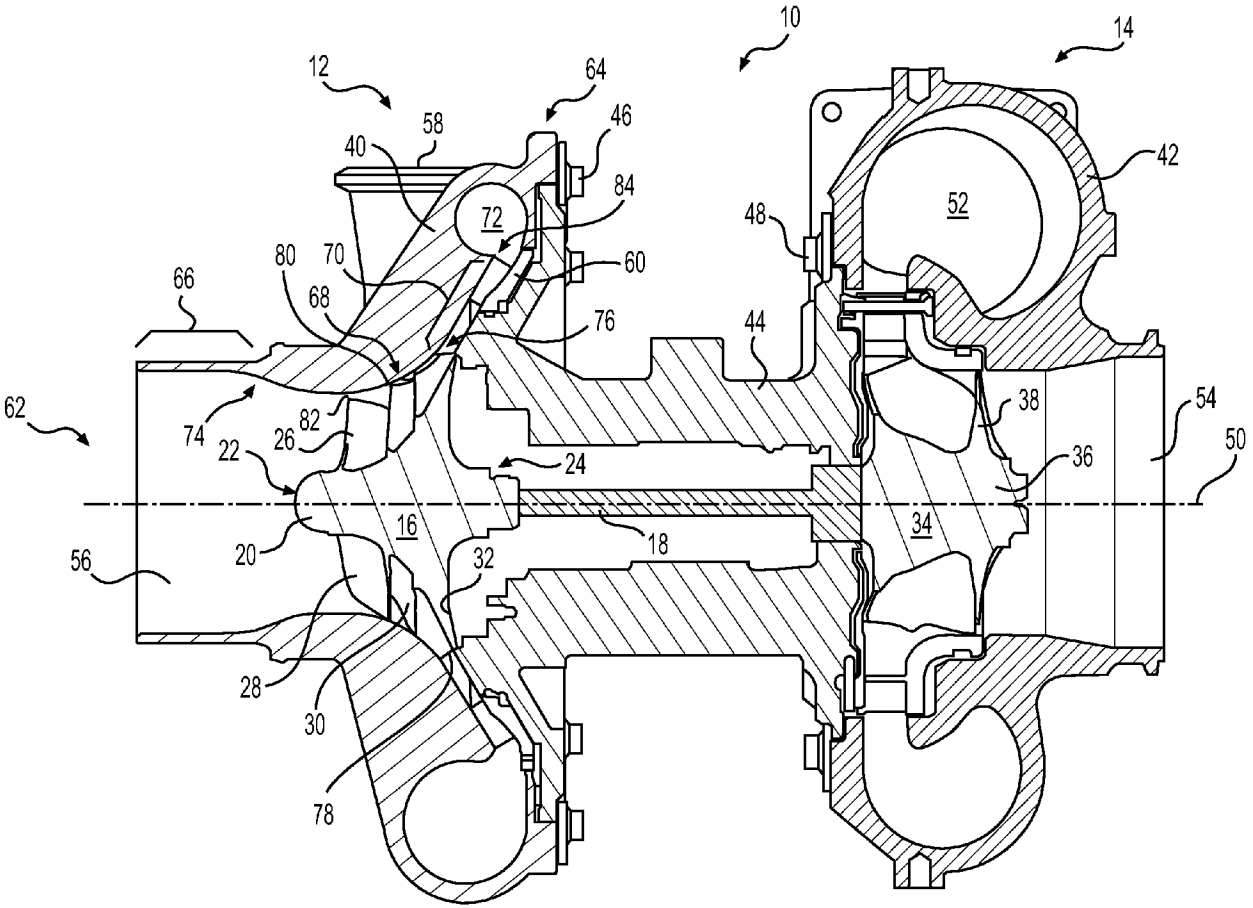
FIG. 1 is a cut-away view of an exemplary disclosed turbocharger.

FIG. 1 illustrates an exemplary embodiment of a turbocharger 10. Turbocharger 10 may be used with an engine (not shown) of a machine that performs some type of operation associated with an industry such as mining, construction, farming, railroad, marine, power generation, or another industry known in the art. As shown in FIG. 1, turbocharger 10 may include compressor stage 12 and turbine stage 14. Compressor stage 12 may embody a fixed geometry compressor impeller 16 attached to a shaft 18. Compressor impeller 16 may include compressor hub 20 that may extend from hub front end 22 to hub rear end 24. Compressor blades 26 may be disposed on compressor hub 20 between hub front end 22 and hub rear end 24 in one or more rows. In one exemplary embodiment as illustrated in FIG. 1, compressor impeller 16 may include first row 28, second row 30, and third row 32 of compressor blades 26. First row 28 of compressor blades 26 may be disposed adjacent hub front end 22. Third row 32 of compressor blades 26 may be disposed adjacent hub rear end 24. Second row 30 of compressor blades 26 may be disposed in between first and third rows 28, 32 of compressor blades 26. Third row 32 of compressor blades 26 may be a rearmost row 32, which may be located closest to hub rear end 24 as compared to first row 30 or second row 32. Although FIG. 1 illustrates only three rows (first row 28, second row 30, and third row 32) of compressor blades 26, it is contemplated that compressor impeller 16 may include any number of rows 28, 30 of compressor blades 26. Turbine stage 14 may include a turbine wheel 34, which may also be attached to shaft 18. Turbine wheel 34 may include turbine hub 36 and turbine blades 38 disposed around turbine hub 36.

Compressor stage 12 may be enclosed by compressor housing 40. Turbine stage 14 may be enclosed by turbine housing 42. Bearing housing 44 may enclose bearings (not shown) that may support shaft 18. Bearing housing 44 may be attached to compressor housing 40 via bolts 46. Likewise, bearing housing 44 may be attached to turbine housing 42 via bolts 48. Compressor impeller 16, shaft 18, turbine wheel 34, compressor housing 40, turbine housing 42, and bearing housing 44 may be disposed around rotational axis 50 of turbocharger 10.

Exhaust gases exiting the engine (not shown) may enter turbine housing 42 via turbine inlet 52 and exit turbine housing 42 via turbine outlet 54. The hot exhaust gases may move through turbine housing 42, expanding against turbine blades 38, rotating turbine wheel 34. Rotation of turbine wheel 34 may rotate shaft 18, which in turn may rotate compressor impeller 16. Air may enter compressor housing 40 via compressor inlet 56 and exit compressor housing 40 via compressor outlet 58. As air moves through compressor stage 12, compressor impeller 16 may spin and accelerate the air. Compressor stage 12 may include diffuser ring 60, which may help slow down the air, causing an increase in the pressure of the air within compressor stage 12. Compressed air from compressor stage 12 may be directed into the engine.

As further illustrated in FIG. 1, compressor housing 40 may extend from compressor front end 62 to compressor rear end 64. Compressor housing 40 may include intake portion 66, transition portion 68, diffuser portion 70, and volute 72. Intake portion 66 may extend from adjacent compressor front end 62 to first distal end 74 disposed between compressor front end 62 and compressor rear end 64. In one exemplary embodiment as illustrated in FIG. 1, first distal end 74 may be disposed adjacent hub front end 22 of compressor impeller 16. Intake portion 66 may have a generally frusto-conical shape, which may help direct air from the ambient into compressor housing 40. It is contemplated, however, that intake portion 66 may have a generally cylindrical or any other type of shape known in the art. Transition portion 68 of compressor housing 40 may extend from first distal end 74 to second distal end 76 disposed between first distal end 74 and compressor rear end 64. In one exemplary embodiment as illustrated in FIG. 1, second distal end 76 may be disposed adjacent outer edge 78 of third row 32 of compressor blades 26. As illustrated in FIG. 1, transition portion 68 may have an inner surface 80 that may be radially separated from outer edges 78 of compressor blades 26 in first, second, and third rows 28, 30, 32 by a radial gap 82. Diffuser portion 70 may extend from second distal end 76 to third distal end 84, which may be disposed adjacent volute 72. Volute 72 may have a generally toroidal shape and may be disposed around rotational axis 50. Volute 72 may be connected to diffuser portion 70 at third distal end 84. Intake portion 66, transition portion 68, and diffuser portion 70 may help direct air from compressor inlet 56 to volute 72 during operation of turbocharger 10.

Figure 2:
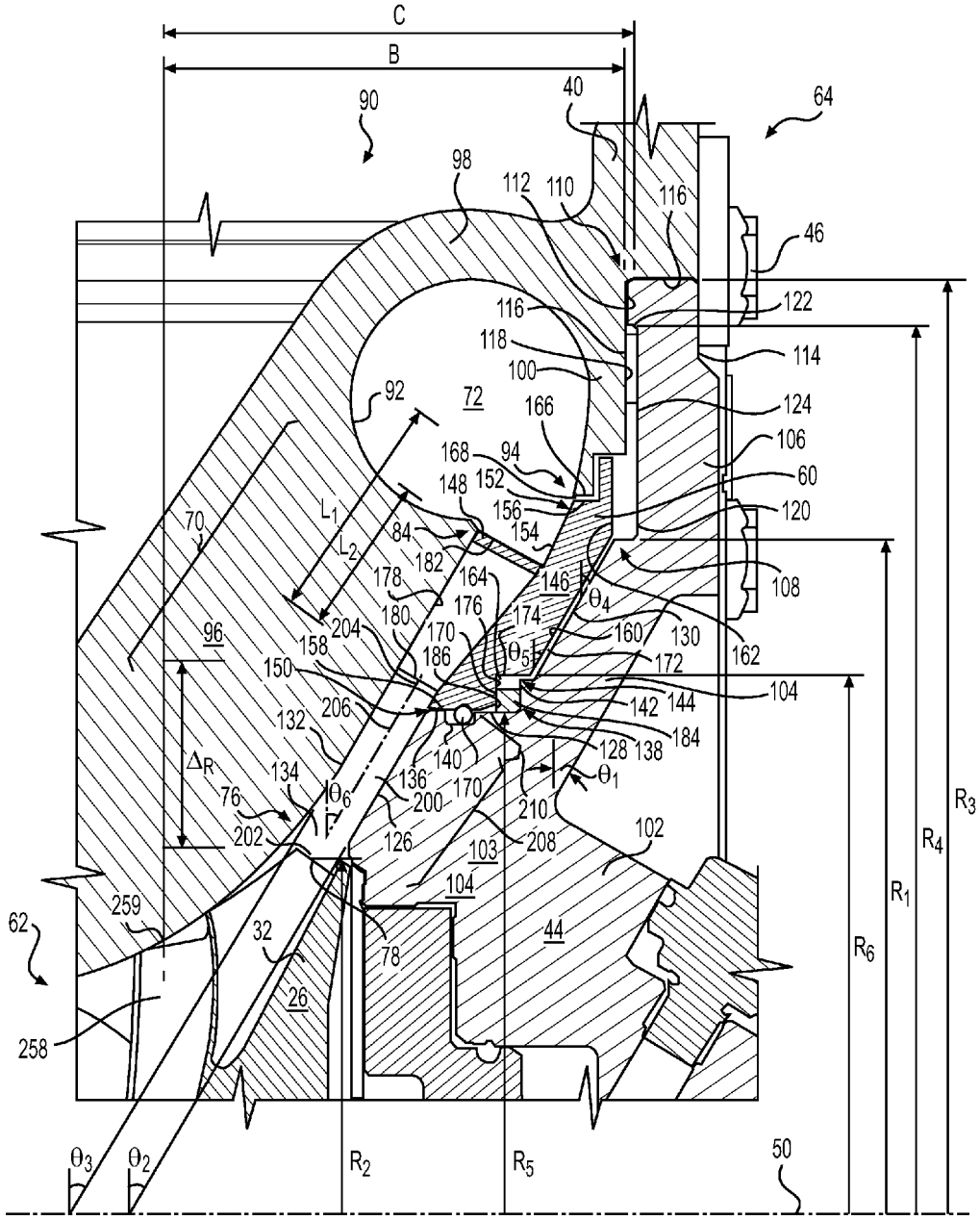
FIG. 2 is a cut-away view of an exemplary disclosed compressor assembly for the turbocharger of FIG. 1.

FIG. 2 illustrates a cut-away view of an exemplary embodiment of compressor assembly 90 of turbocharger 10. As illustrated in FIG. 2, volute 72 may have a volute inner surface 92 that may extend from third distal end 84 to fourth distal end 94. In one exemplary embodiment as illustrated in FIG. 2, volute inner surface 92 may have a generally circular cross-section. Fourth distal end 94 may be axially spaced apart from third distal end 84 in a direction towards compressor rear end 64. Volute 72 may be bounded by diffuser portion wall 96, volute top wall 98, and volute rear wall 100. Volute rear wall 100 may be axially separated from diffuser portion wall 96. Volute top wall 98 may connect diffuser portion wall 96 and volute rear wall 100 to form a continuous and smooth volute inner surface 92.

As also illustrated in FIG. 2, bearing housing 44 may include body portion 102, web 104, and bearing housing flange 106. Body portion 102 of bearing housing 44 may be disposed symmetrically around rotational axis 50. Web 104 may extend outward from body portion 102 to web end 108. In one exemplary embodiment as illustrated in FIG. 2, web end 108 may be disposed adjacent fourth distal end 94 and volute rear wall 100. Web end 108 may have a radius "$R_1$," which may be larger than a radius "$R_2$" of outer edge 78 of third row 32 of compressor blades 26. As also illustrated in FIG. 2, for example, web 104 may be generally inclined at an angle $\theta_1$ relative to an axial plane disposed generally orthogonal to rotational axis 50. One of ordinary skill in the art would recognize that surfaces inclined at an angle relative to an axial plane disposed generally orthogonal to rotational axis 50 would correspondingly be inclined relative to rotational axis 50.

Bearing housing flange 106 may extend radially outward from web end 108 to bearing housing flange end 110. In one exemplary embodiment as illustrated in FIG. 2, bearing housing flange 106 may be disposed generally orthogonal to rotational axis 50. Bearing housing flange 106 may have flange front face 112 and a flange rear face 114 disposed opposite to flange front face 112. Bearing housing flange 106 may also have a generally cylindrical flange outer surface 116, which may have a radius "$R_3$," which may be larger than radius $R_1$ of web end 108. Flange front face 112 may be disposed adjacent to and may abut on rear face 118 of volute rear wall 100.

Bearing housing flange 106 may also include a flange recess 120, which may extend axially inwards from flange front face 112 towards flange rear face 114. Flange recess 120 may extend radially from adjacent web end 108 to recess outer edge 122. In one exemplary embodiment as illustrated in FIG. 2, recess outer edge 122 may have a radius "$R_4$," smaller than radius $R_3$ of flange outer surface 116. Flange recess 120 may have a recess seating surface 124 disposed axially spaced apart from flange front face 112 and rear face 118 of volute rear wall 100. Recess seating surface 124 may have a generally annular shape and may extend from adjacent web end 108 to adjacent recess outer edge 122. Bearing housing flange 106 may be attached to volute rear wall 100 of compressor housing 40 via one or more bolts 46.

Web 104 may include a first web face 126, ledge 128, and second web face 130. First web face 126 may extend outward from adjacent outer edge 78 of third row 32 to ledge 128 disposed between outer edge 78 and web end 108. First web face 126 may be inclined at an angle "$\theta_2$" relative to an axial plane disposed generally orthogonal to rotational axis 50. First web face 126 may be disposed opposite to and axially spaced apart from inner wall 132 of diffuser portion 70 of compressor housing 40. Inner wall 132 may be inclined at an angle "$\theta_3$" relative to an axial plane disposed generally orthogonal to rotational axis 50. First web face 126 and inner wall 132 may form passageway 134. First web face 126 and inner wall 132 may have a smooth shape that may help ensure that air can travel from outer edges 78 of compressor blades 26 through passageway 134 without significantly altering a velocity or direction of the air. In one exemplary embodiment, first web face 126 may have a smooth curvilinear shape that may conform to a shape of compressor blades 26. Likewise, inner wall 132 may have a smooth curvilinear shape that may conform to a surface defined by outer edges 78 of compressor blades 26 in first, second, and third rows 28, 30, 32.

Ledge 128 may have a generally cylindrical ledge outer surface 136, which may have a radius "$R_5$" relative to rotational axis 50. Ledge outer surface 136 may extend axially from first web face 126 to ledge end 138 disposed between first web face 126 and compressor rear end 64. Radius $R_5$ of ledge outer surface 136 may be larger than a radius "$R_2$" of outer edges 78 of compressor blades 26 in third row 32. Ledge outer surface 136 may also include a generally annular groove 140. Ledge 128 may include ledge axial face 142 that may be axially spaced apart from first web face 126. Ledge axial face 142 may be disposed at ledge end 138. Ledge axial face 142 may extend radially outward from ledge outer surface 136 to second web face 130. In one exemplary embodiment as illustrated in FIG. 2, ledge axial face 142 may intersect second web face 130 at ledge axial face end 144. In one exemplary embodiment as illustrated in FIG. 2, ledge axial face 142 may be disposed generally orthogonal to rotational axis 50. Second web face 130 may extend from ledge axial face end 144 to web end 108. Second web face 130 may be inclined at an angle "$\theta_4$" relative to an axial plane disposed generally orthogonal to rotational axis 50.

Diffuser ring 60 may be disposed between inner wall 132 of compressor housing 40 and second web face 130 of bearing housing 44. Diffuser ring 60 may include back plate 146 and one or more vanes 148. In one exemplary embodiment as illustrated in FIG. 2, back plate 146 may extend from back plate leading edge 150 to back plate trailing edge 152. Back plate 146 may have a generally annular shape. In one exemplary embodiment as illustrated in FIG. 2, back plate leading edge 150 may be disposed adjacent ledge outer surface 136 and back plate trailing edge 152 may be disposed adjacent fourth distal end 94. Back plate 146 may include front face 154, top face 156, bottom face 158, inclined rear face 160, axial rear face 162, and recess 164. Front face 154 of back plate 146 may extend from back plate leading edge 150 to back plate trailing edge 152. Front face 154 may have a generally curvilinear and smooth shape and may be disposed opposite to and axially spaced apart from inner wall 132 of compressor housing 40. Front face 154 may be shaped to help ensure air from passageway 134 may smoothly flow over front face 154.

Top face 156 of back plate 146 may extend axially from front face 154 to axial rear face 162 disposed adjacent recess seating surface 124. Top face 156 may have a generally cylindrical shape. Top face 156 may be disposed adjacent inner face 166 of volute rear wall 100. Inner face 166 of volute rear wall 100 may also have a generally cylindrical shape. Top face 156 of back plate 146 may be radially separated from inner face 166 by a radial gap 168. Bottom face 158 of back plate 146 may extend axially from front face 154 towards inclined rear face 160 disposed adjacent second web face 130. Bottom face 158 may abut on ledge outer surface 136. Bottom face 158 may have a generally cylindrical shape. It is contemplated, however, that bottom face 158 may have a non-cylindrical shape. Seal member 170 may be disposed in groove 140 between ledge outer surface 136 and bottom face 158. In one exemplary embodiment as illustrated in FIG. 2, seal member 170 may be an O-ring. It is contemplated, however, that seal member 170 may be a gasket or any other type of sealing element known in the art. Seal member 170 may prevent recirculation of air around back plate 146.

Axial rear face 162 of back plate 146 may be axially separated from front face 154 of back plate 146. Axial rear face 162 may extend radially inward from top face 156 to adjacent web end 108. Axial rear face 162 may connect top face 156 with inclined rear face 160. In one exemplary embodiment as shown in FIG. 2, axial rear face 162 may be disposed generally orthogonal to rotational axis 50. Inclined rear face 160 may extend from axial rear face 162 adjacent web end 108 to adjacent ledge axial face end 144. Inclined rear face 160 may be inclined at an angle "$\theta_5$" relative to a plane disposed generally orthogonal to rotational axis 50. One of ordinary skill in the art would recognize that inclined rear face 160 would be inclined relative to top face 156 and axial rear face 162. Inclined rear face 160 may be axially separated from front face 154 of back plate 146. Inclined rear face 160 may be disposed adjacent second web face 130. In one exemplary embodiment as illustrated in FIG. 2, inclined rear face 160 may be axially separated from second web face 130 by cavity 172. Seal member 170 may prevent a flow of air from volute 72 to passageway 134 via cavity 172.

Recess 164 may be disposed adjacent bottom face 158 and between bottom face 158 and inclined rear face 160. Recess 164 may include recess upper face 174 and recess side face 176. Recess upper face 174 may have a generally cylindrical shape and may extend axially from inclined rear face 160 towards front face 154. Recess upper face 174 may be radially separated from ledge outer surface 136. In one exemplary embodiment as illustrated in FIG. 2, recess upper face 174 may have a radius "$R_6$" relative to rotational axis 50. Radius $R_6$ may be larger than radius $R_5$ of ledge outer surface 136. Recess side face 176 may extend radially inward from recess upper face 174 to bottom face 158. In one exemplary embodiment, recess side face 176 may have a generally annular shape, which may be disposed generally orthogonal to rotational axis 50. Recess side face 176 may be axially disposed between ledge axial face 142 and front face 154. Recess side face 176 may be axially separated from ledge axial face 142.

Vane 148 may extend radially and axially outward from front face 154 of back plate 146 to vane tip 178. In one exemplary embodiment as illustrated in FIG. 2, vane tip 178 may abut on inner wall 132 of compressor housing 40. Vane 148 may extend from a vane leading edge 180 to a vane trailing edge 182. Vane leading edge 180 may be disposed adjacent back plate leading edge 150. Vane leading edge 180 may intersect front face 154 of back plate 146 at a location which may be offset from back plate leading edge 150. For example, as illustrated in FIG. 2, vane leading edge 180 may intersect front face 154 of back plate 146 at a location disposed between back plate leading edge 150 and back plate trailing edge 152. As illustrated in FIG. 2, vane 148 may extend over a portion of front face 154 of back plate 146 so that vane trailing edge 182 may be offset from back plate trailing edge 152. Thus, for example, a length "$L_1$" of front face 154 may be larger than a length "$L_2$" of vane 148. Air from passageway 134 may flow between vanes 148 and enter volute 72. A shape of each vane 148 and a circumferential spacing between vanes 148 may be selected so that vanes 148 may help reduce a speed of the air flowing between vanes 148, thereby helping to increase a pressure of the air in volute 72.

Wave spring 184 may be disposed in recess 164 between ledge axial face 142 and recess side face 176 of recess 164 in back plate 146. Wave spring 184 may have a generally annular shape having an inner radius, which may be larger than a radius $R_5$ of ledge outer surface 136. Wave spring 184 may include a plurality of waves on axial face 186 of wave spring 184. In one exemplary embodiment, wave spring 184 may have about 11 waves. Wave spring 184 may have an axial thickness ranging from 2 mm to 4 mm. In an assembled configuration as illustrated in the exemplary embodiment of FIG. 2, wave spring 184 may have a thickness ranging from about 1.5 mm to about 2.5 mm. Wave spring 184 may have a spring constant ranging from about 20 to 30 N/mm (Newtons per mm). Wave spring 184 may apply an axial load on back plate 146 to urge vane tips 178 to firmly abut on and remain in contact with inner wall 132 of compressor housing 40. By helping to keep vane tips 178 firmly in contact with inner wall 132, wave spring 184 may help ensure that no appreciable amount of air can leak from passageway 134 into volute 72 via gaps between vane tips 178 and inner wall 132 of compressor housing 40.

As also illustrated in FIG. 2, vanes 148 may be disposed nearer to volute 72 as compared to outer edges 78 of compressor blades 26 so as to define a vaneless space 200. Vaneless space 200 may extend within passageway 134 from outer edges 78 of compressor blades 26 in third row 32 to vane leading edges 180. Vaneless space 200 may have a generally annular shape extending between inner wall 132 of compressor housing 40 and first web face 126 of bearing housing 44. In one exemplary embodiment, a radial extent "$\Delta R$" of vaneless space 200 between midpoints 202 and 204 may range from about 20% to 40% of a maximum radius $R_2$ of compressor blades 26.

Vaneless space 200 may be inclined at an angle "$\theta_6$" relative to an axial plane disposed generally orthogonal to rotational axis 50. Angle $\theta_6$ may be measured between an axis 206 of vaneless space 200 and an axial plane disposed generally orthogonal to rotational axis 50. For example, axis 206 of vaneless space 200 may be defined as a line connecting midpoints 202 and 204 of passageway 134. Midpoint 202 may be disposed adjacent an outer edge 78 of compressor blades 26. Midpoint 204 may be disposed adjacent a vane leading edge 180. As used in this disclosure midpoint 202 may be disposed within passageway 134 halfway between inner wall 132 and second web face 130. Similarly, midpoint 204 may be disposed within passageway 134 halfway between inner wall 132 and front face 154 of back plate 146. One of ordinary skill in the art would recognize that axis 206 may not always be disposed parallel to inner wall 132 and/or second web face 130. As also illustrated in FIG. 2, a portion 208 of vaneless space 200 may be disposed between inner wall 132 and second web face 130. A remaining portion 210 of vaneless space 200 may be disposed between inner wall 132 and front face 154 of back plate 146.

The above description refers to angles $\theta_1$, $\theta_2$, $\theta_3$, $\theta_4$, $\theta_5$, and $\theta_6$. It is contemplated that angles $\theta_1$, $\theta_2$, $\theta_3$, $\theta_4$, $\theta_5$, and $\theta_6$ may be equal or unequal. In one exemplary embodiment, each of angles $\theta_1$, $\theta_2$, $\theta_3$, $\theta_4$, $\theta_5$, or $\theta_6$ may range from about 0° to about 45°.

Figure 3:
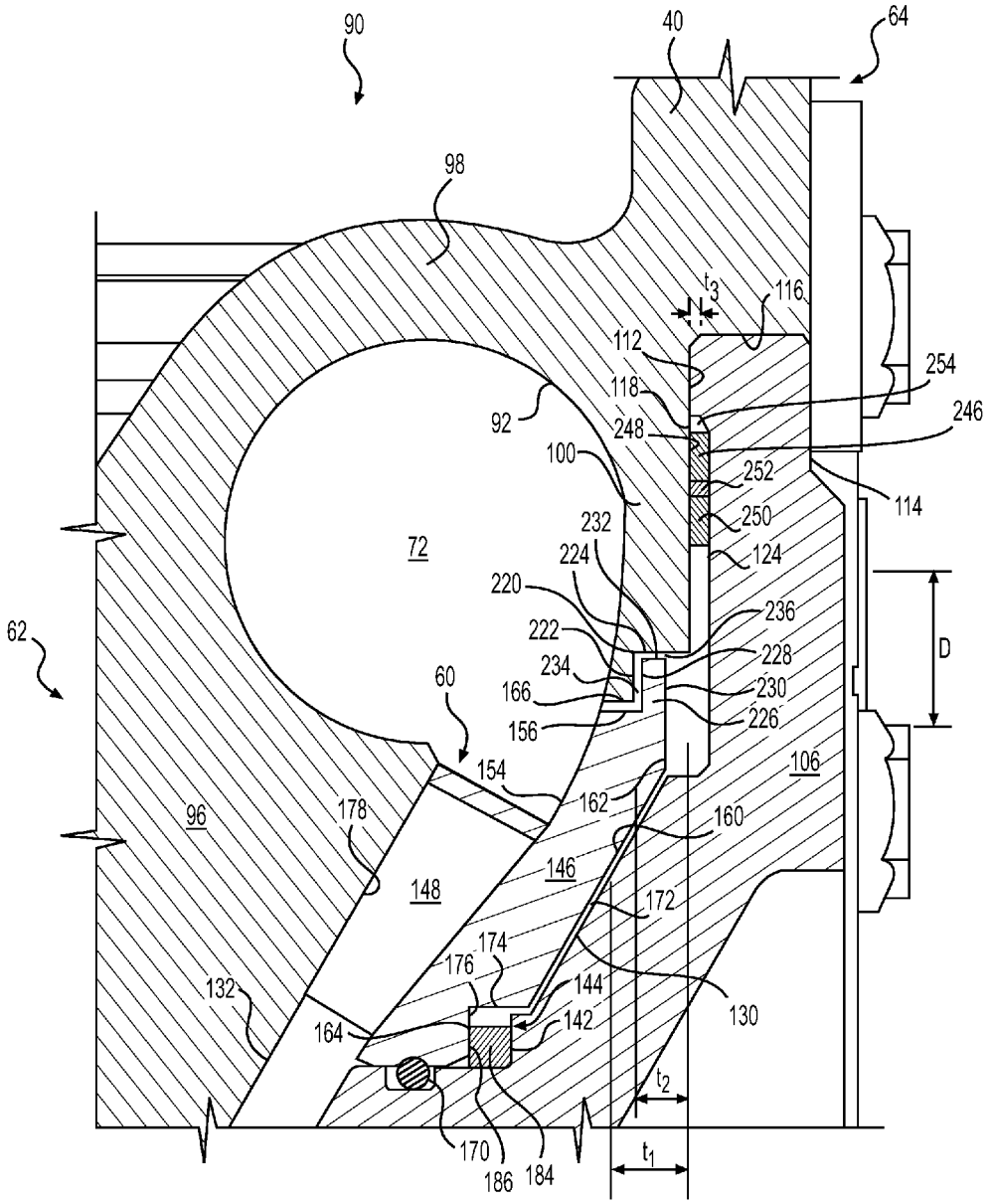
FIG. 3 is a another cut-away view of the exemplary disclosed compressor assembly for the turbocharger of FIG. 1.

FIG. 3 illustrates another cut-away view of an exemplary embodiment of compressor assembly 90 of turbocharger 10. As illustrated in FIG. 3, volute rear wall 100 may include recess 220, which may extend axially from rear face 118 of volute rear wall 100 towards volute inner surface 92. Volute rear wall 100 may have a thickness "$t_1$." Recess 220 may have a depth "$t_2$," which may be smaller than thickness $t_1$. Recess 220 may include recess rear face 222, which may be disposed generally orthogonal to rotational axis 50. Recess rear face 222 may be disposed generally parallel to axial rear face 162 of back plate 146 of diffuser ring 60. Recess 220 may also include recess side surface 224, which may extend axially from rear face 118 of volute rear wall 100 to recess rear face 222.

As illustrated in FIG. 3, back plate 146 of diffuser ring 60 may include one or more tabs 226 disposed circumferentially around back plate 146. A circumferential spacing between tabs 226 may be uniform or non-uniform. Tab 226 may extend radially outward from top face 156. Tab 226 may have a tab front face 228 and a tab rear face 230 disposed opposite tab front face 228. Tab 226 may also have tab side surface 232 extending between tab front face 228 and tab rear face 230. Tab front face 228 may be disposed adjacent to and axially separated from recess rear face 222 by an axial gap 234. Tab side surface 232 may be radially separated from recess side surface 224 by a radial gap 236.

Figure 4:
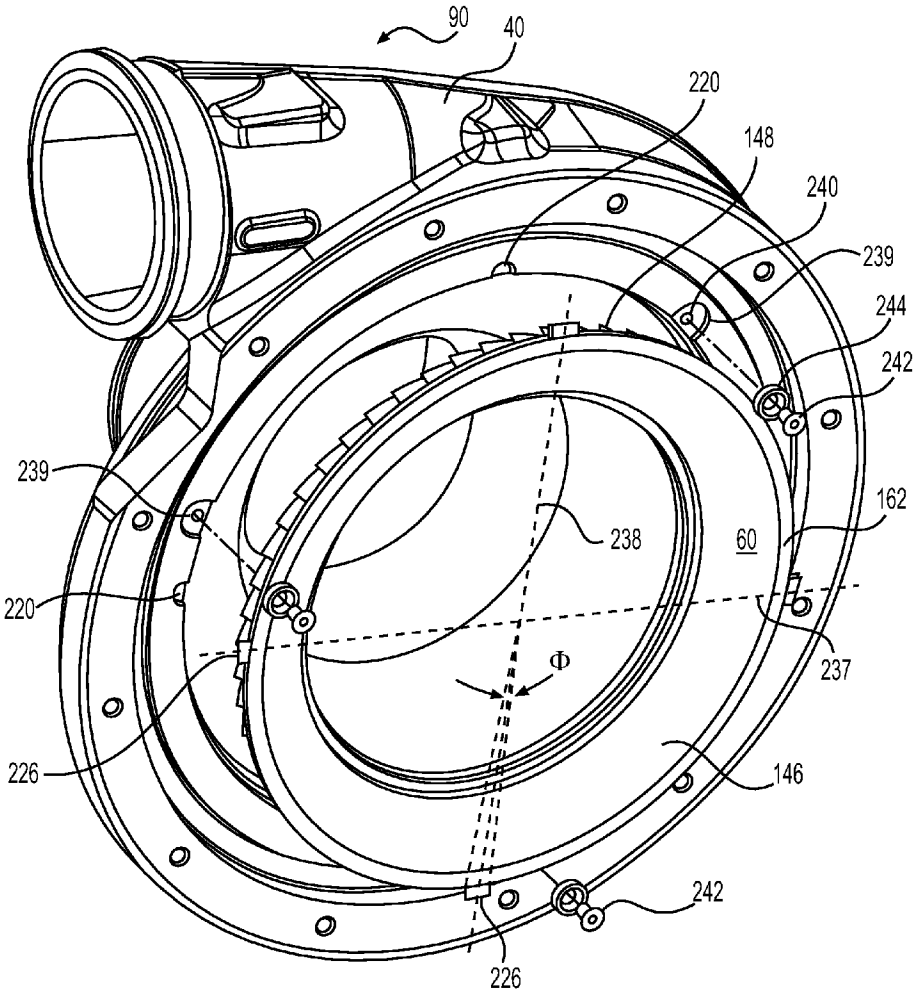
FIG. 4 is a pictorial view of a portion of the exemplary disclosed compressor assembly of FIG. 2.

FIG. 4 illustrates a pictorial view of an exemplary embodiment of compressor assembly 90. As illustrated in FIG. 4, tab 226 may span a circumferential angle "4)." In one exemplary embodiment, angle $\varphi$ may range from about 5° to 10°. As illustrated in FIG. 4, a first tab 226 may be disposed about a first diametrical axis 237 and a second tab 226 may be disposed about a second diametrical axis 238. In one exemplary embodiment as illustrated in FIG. 4, first diametrical axis 237 may be disposed generally orthogonal to second diametrical axis 238. It is contemplated, however, that first diametrical axis 237 may be disposed at any angle relative to second diametrical axis 238. Further, as illustrated in the exemplary embodiment of FIG. 4, back plate 146 may have about 4 tabs 226. It is contemplated, however, that back plate 146 may have any number of tabs 226. Tabs 226 may engage with recesses 220 in volute rear wall 100. Tabs 226 may be configured to act as anti-rotational features that prevent rotation of back plate 146 around rotational axis 50.

As further illustrated in FIG. 4, volute rear wall 100 may include one or more recesses 239. Recess 239 may have a depth, which may be smaller than depth $t_2$ of recess 220. Recess 239 may include a hole 240, which may be threaded. Back plate 146 may be attached to volute rear wall 100 by a fastener 242. Fastener 242 may pass through washer 244 and threadingly engage with threads in hole 240. Washer 244 may abut on volute rear wall 100 and axial rear face 162 of diffuser ring 60 to attach diffuser ring 60 to volute rear wall 100. Depths of recesses 220 and 239 may be selected such that tab front face 228 may remain axially separated from recess rear face 222 of volute rear wall 100. In one exemplary embodiment as illustrated in FIG. 4, back plate 146 of diffuser ring 60 may include about four tabs 226. As also illustrated in the exemplary embodiment of FIG. 4, diffuser ring 60 may be attached to volute rear wall 100 using about three washers 244 and three fasteners 242. It is contemplated, however, that any number of washers 244 and fasteners 242 may be used to attach volute rear wall 100 and diffuser ring 60.

Returning to FIG. 3, compressor stage 12 may include shim 246. Shim 246 may have a generally annular shape and may be disposed around rotational axis 50. Shim 246 may have a shim front face 248 disposed adjacent to and abutting on rear face 118 of volute rear wall 100. Shim 246 may also have a shim rear face 250 disposed opposite shim front face 248. Shim rear face 250 may be disposed adjacent to and may abut on recess seating surface 124. In one exemplary embodiment as illustrated in FIG. 3, shim 246 may be attached to bearing housing flange 106 using one or more rivets 252. Rivets 252 may be circumferentially spaced from each other. A circumferential spacing between rivets 252 may be uniform or non-uniform. In one exemplary embodiment a number of rivets 252 may range from about 6 to 12. Although the above description refers to rivets 252, it is contemplated that bolts, screws, or any other types of fasteners known in the art may be used to attach shim 246 to bearing housing flange 106. Shim 246 may be configured to define a space 254 between shim front face 248 and recess seating surface 124. Shim 246 and consequently space 254 may have a thickness "$t_3$," which may be selected so that gaps between vane tips 178 and inner wall 132 of compressor housing 40 can be reduced or eliminated after assembly of compressor housing 40 with bearing housing 44.

Figure 5:
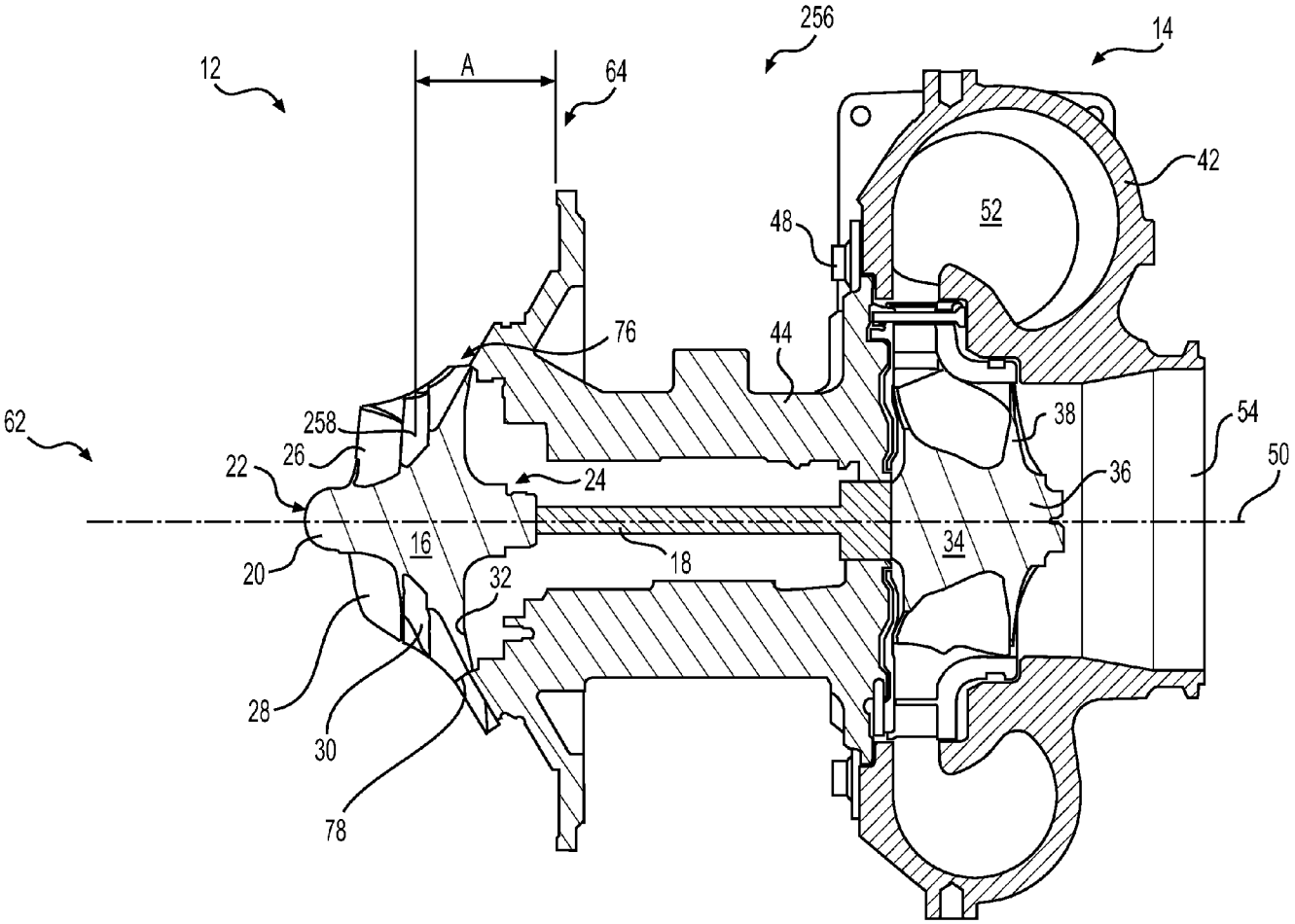
FIG. 5 is a cut-away view of an exemplary disclosed turbocharger cartridge for the turbocharger of FIG. 1.

FIG. 5 illustrates a pictorial view of an exemplary embodiment of turbocharger cartridge 256. As illustrated in FIG. 5, turbocharger cartridge 256 may include compressor impeller 16, shaft 18, turbine wheel 34, turbine housing 42, and bearing housing 44. Dimensional measurements of turbocharger cartridge 256 combined with dimensional tolerances on compressor housing 40 may be used to determine a maximum required thickness $t_3$ of shim 246. These dimensional measurements and dimensional tolerances may be used to select thickness $t_3$ of shim 246 so that vane tips 178 may be firmly in contact with inner wall 132 of compressor housing 40 without introducing a gap between vane tips 178 and inner wall 132. Thus, shim 246 and turbocharger cartridge 256 may constitute a matched set. By selecting thickness $t_3$ of shim 246 in this manner, gaps between vane tips 178 and inner wall 132 may depend only on the dimensional tolerances of compressor housing. In one exemplary embodiment, thickness $t_3$ may be selected as a maximum thickness that may be required to ensure that vane tips 178 come into contact with inner wall 132 based on the dimensional tolerances of compressor housing 40. In particular, an axial load may be applied to shaft 18, pushing compressor impeller 16 away from turbine housing 42 and towards compressor front end 62. An axial distance "A" between recess seating surface 124 and a gage location 258, on compressor impeller 16, may be measured.

An axial distance "B" (see FIG. 2) may be measured between rear face 118 of volute rear wall 100 and a gage location 259 on inner wall 132 of compressor housing 40. Gage location 259 may be a predetermined location on inner wall 132 of compressor housing 40. In one exemplary embodiment as illustrated in FIG. 2, gage location 259 may be disposed adjacent to gage location 258. Further, a variation in distance B may be determined based on known manufacturing tolerances. Additionally or alternatively, the variation in distance B may be determined based on measurements of distance B on a plurality of compressor housings 40. A maximum thickness $t_3$ may be determined based on distance A, distance B, and the variation of distance B, so that that vane tips 178 may remain in contact with inner wall 132 of compressor housing 40. For example, thickness $t_3$ may be selected so that a distance "C" between recess seating surface 124 of bearing housing flange 106 and gage location 259 may be greater than or equal to a sum of thickness $t_3$ (see FIG. 3) and a maximum value of distance B determined based on the variation in distance B. Shim 246 having the maximum required thickness $t_3$ may be attached to bearing housing flange 106 of bearing housing 44 in turbocharger cartridge 256. In one exemplary embodiment thickness $t_3$ of shim 246 may range from about 1.5 mm to about 2.5 mm.

Figure 6:
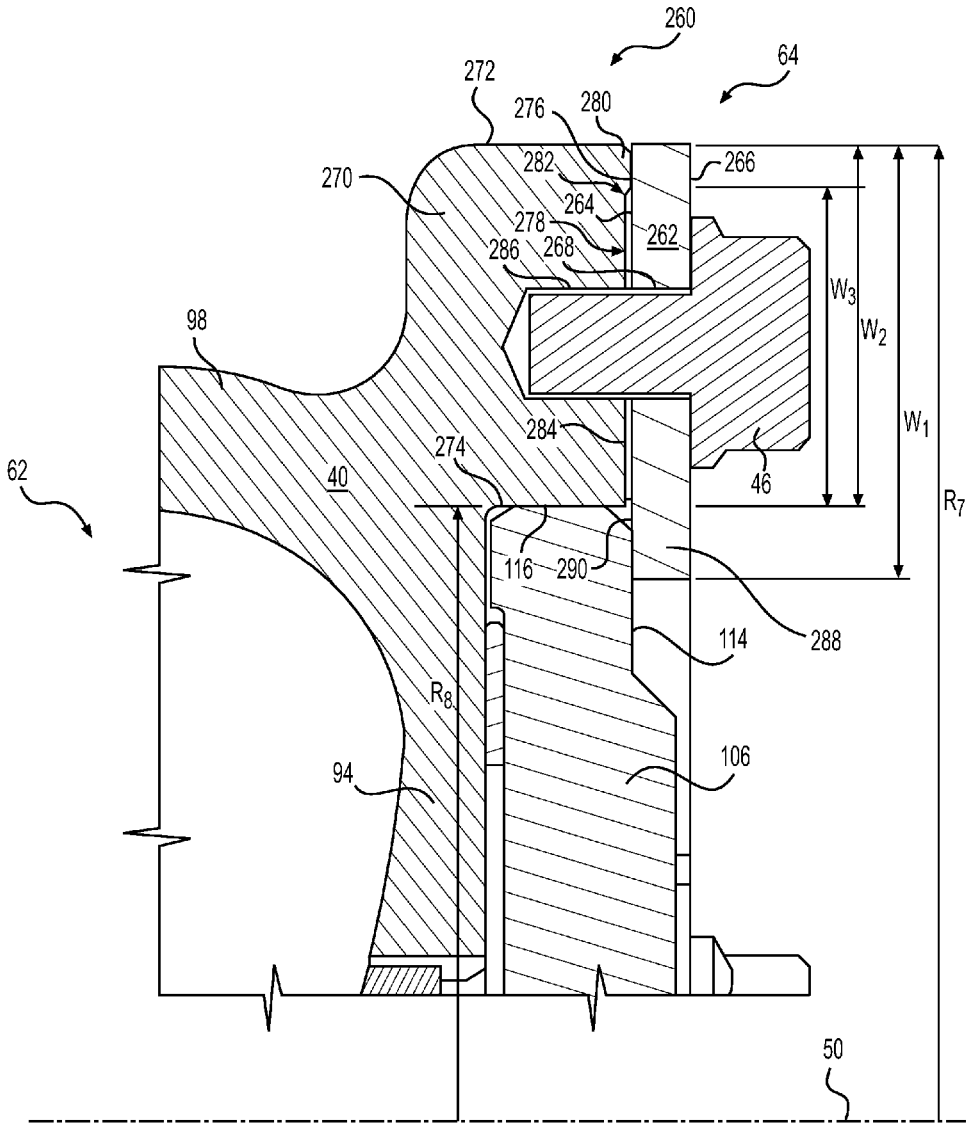
FIG. 6 is a cut-away view of an exemplary disclosed compressor housing assembly for the turbocharger of FIG. 1.

FIG. 6 illustrates a cut-away view of an exemplary embodiment of compressor housing assembly 260 for compressor assembly 90 of turbocharger 10. Compressor housing assembly 260 includes one or more clamping plates 262 and one or more bolts 46 that cooperate to connect compressor housing 40 with bearing housing flange 106 of bearing housing 44. Clamping plate 262 may abut on compressor housing 40 and bearing housing flange 106. In one exemplary embodiment, clamping plate 262 may be a single generally annular plate disposed around rotational axis 50. Clamping plate 262 may have a front face 264 and a rear face 266 disposed opposite to and axially spaced apart from front face 264. A plurality of holes 268 may be disposed on clamping plate 262. Holes 268 may be circumferentially spaced from each other. A circumferential spacing between holes 268 may be uniform or non-uniform. Holes 268 may be through holes that may extend from front face 264 to rear face 266. In some exemplary embodiments, holes 268 may have threads. Clamping plate 262 may have a radial width "$W_1$."

Compressor housing 40 may have a compressor housing flange 270 attached to volute top wall 98 and volute rear wall 100. Compressor housing flange 270 may have a generally cylindrical flange outer surface 272. Flange outer surface 272 may have a radius "$R_7$" relative to rotational axis 50. Compressor housing flange 270 may also include flange inner surface 274, which may have a radius "$R_8$" relative to rotational axis 50. Radius $R_8$ may be larger than or about equal to radius $R_3$ of flange outer surface 116 of bearing housing flange 106. Radius $R_8$ may also be smaller than radius $R_7$. Flange inner surface 274 may be disposed adjacent to and may abut on flange outer surface 116 of bearing housing flange 106 of bearing housing 44. Compressor housing flange 270 may include a clamping face 276, which may extend radially from flange inner surface 274 at radius $R_8$ to flange outer surface 272 at radius $R_7$. Clamping face 276 may have a radial width "$W_2$," which may be smaller than a width $W_1$ of clamping plate 262.

Clamping face 276 of compressor housing flange 270 may include compressor flange recess 278 and compressor flange lip 280. Compressor flange recess 278 may extend axially inwards from clamping face 276 towards compressor front end 62 forming compressor flange lip 280 on clamping face 276. Compressor flange recess 278 may extend radially outward from flange inner surface 274 to recess outer edge 282 disposed between flange inner surface 274 and flange outer surface 272. Compressor flange recess 278 may have a radial width "$W_3$," which may be smaller than a radial width $W_2$ of clamping face 276. In one exemplary embodiment width $W_3$ may range from about 70% to about 90% of width $W_2$. As illustrated in FIG. 6, compressor flange recess 278 may include a recess surface 284 axially spaced apart from clamping face 276 of clamping plate 262. In one exemplary embodiment, an axial spacing of recess surface 284 from clamping face 276 may range from about 0.8 mm to about 1.4 mm. Recess surface 284 may extend radially outward from flange inner surface 274 to recess outer edge 282. Compressor flange lip 280 may be disposed adjacent recess outer edge 282 of compressor flange recess 278. Compressor flange lip 280 may extend radially outward from recess outer edge 282 to flange outer surface 272. As also illustrated in FIG. 6, front face 264 of clamping plate 262 may abut on compressor flange lip 280.

Recess surface 284 of compressor housing flange 270 may include a plurality of holes 286. Like holes 268, holes 286 may be circumferentially spaced from each other. A circumferential spacing between holes 286 may be uniform or non-uniform. Holes 286 may be arranged so as to align with holes 268. Holes 286 may also be threaded. Bolts 46 may pass through holes 268 and may be threadingly received in holes 286 to help connect clamping plate 262 with compressor housing flange 270. In some exemplary embodiments, bolts 46 may be also threadingly received in holes 268. Although FIG. 6 illustrates bolts 46 being assembled with holes 268 and/or holes 286, it is contemplated that threaded studs (not shown) may be threadingly assembled into holes 286 and nuts (not shown) abutting on rear face 266 of clamping plate 262 may be attached to the studs to connect clamping plate 262 to compressor housing flange 270.

Clamping plate 262 may include clamping plate overhang portion 288, which may extend radially inward from adjacent flange inner surface 274. Overhang portion 288 may include a front face portion 290 that may abut on flange rear surface 114 of bearing housing flange 106. As illustrated in FIG. 6, clamping face 276 of compressor housing flange 270 may be disposed generally coplanar with flange rear surface 114 of bearing housing flange 106. As also illustrated in FIG. 6, clamping plate 262 may extend over compressor flange recess 278 and abut on compressor flange lip 280 and flange rear face 114 of bearing housing flange 106. Supporting clamping plate 262 at two radial locations in this manner may help minimize and/or eliminate bending loads transferred by clamping plate 262 to bolts 46. Further, compressor flange recess 278 may permit clamping plate 262 to bend in compressor flange recess 278 between compressor flange lip 280 and bearing housing flange 106, when bolts 46 are turned, helping to generate tensile loads in bolts 46. Tensile loads generated in bolts 46 may in turn help to firmly attach clamping plate 262 to compressor housing flange 270 and bearing housing flange 106.

Figure 7:
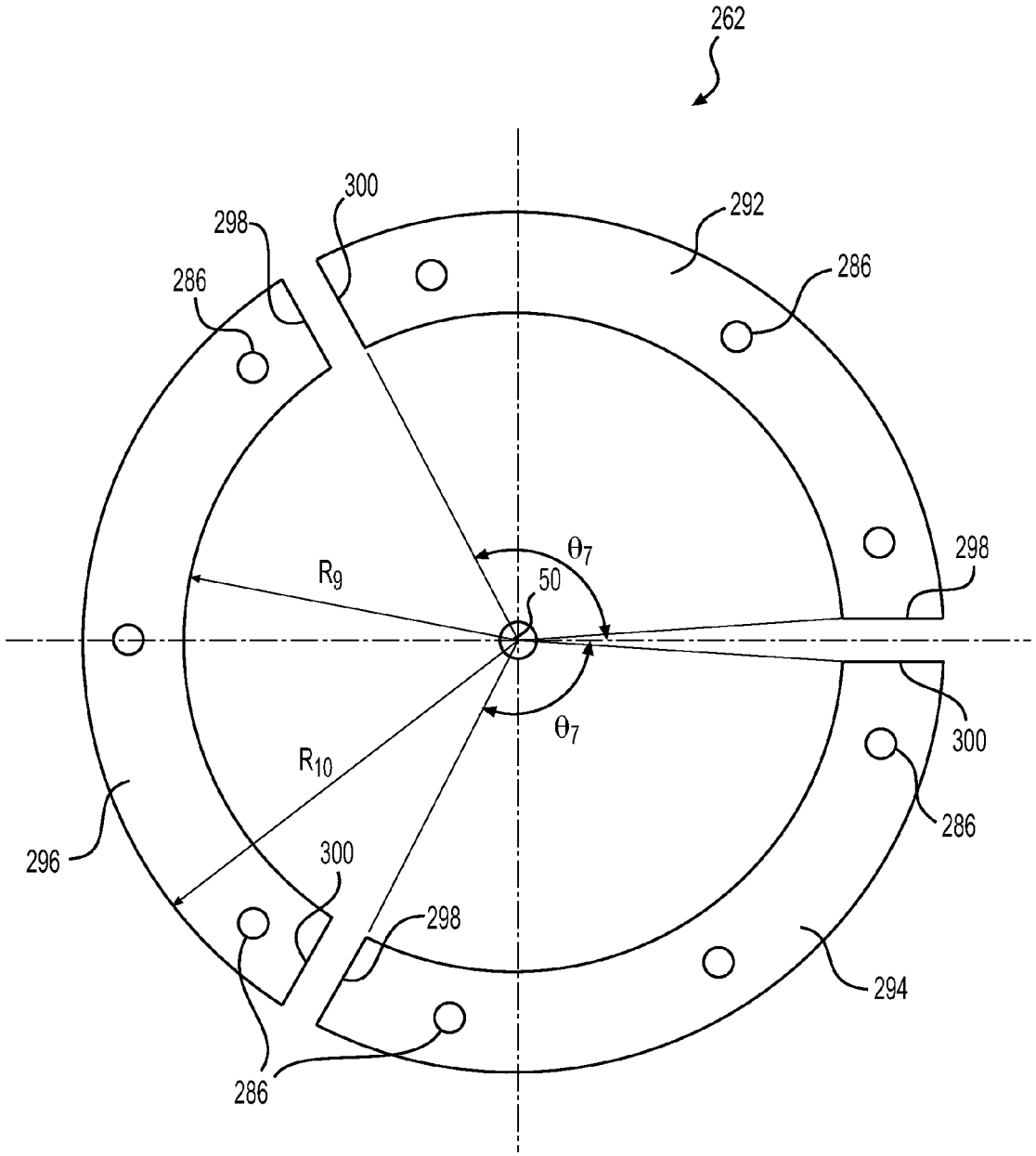
FIG. 7 is a pictorial illustration of an exemplary disclosed clamping plate for the compressor housing assembly of FIG. 6 or the turbine housing assembly of FIG. 8.

FIG. 7 illustrates another exemplary embodiment of clamping plate 262, which may have one or more segments. FIG. 7 illustrates a view of clamping plate 262 on a plane disposed generally orthogonal to rotational axis 50. As illustrated in FIG. 7, clamping plate 262 may include first clamping plate segment 292, second clamping plate segment 294, and third clamping plate segment 296. Each of first second and third clamping plate segments 292, 294, 296 may be an annular arc-shaped plates having one or more holes 286. As illustrated in FIG. 7, first, second, and third clamping plate segments 292, 294, 296 may be circumferentially disposed so as to circumscribe rotational axis 50 so that holes 286 may also be circumferentially disposed around rotational axis 50. In one exemplary embodiment as illustrated in FIG. 7, each of first second and third clamping plate segments 292, 294, 296 may include three holes 286 circumferentially spaced equidistant from each other. It is contemplated, however, that each of first second and third clamping plate segments 292, 294, 296 may include any number of holes 286, which may or may not be disposed circumferentially equidistant from each other. Each of first, second, and third clamping plate segments 292, 294, 296 may have an inner radius "$R_9$" and an outer radius "$R_{10}$" greater than $R_9$. It is contemplated, however, that first, second, and third clamping plate segments 292, 294, 296 may have the same or different radii $R_9$ and $R_{10}$. Each of first, second, and third clamping plate segments 292, 294, 296 may span a circumferential angle "$\theta_7$." For example, circumferential angle $\theta_7$ may be an angle between leading edge 298 to trailing edge 300 of first, second, and third clamping segments 292, 294, 296. It is contemplated, however, that first, second, and third clamping plate segments 292, 294, 296 may span the same or different circumferential angles $\theta_7$. Although three clamping plate segments have been illustrated in FIG. 7, it is contemplated that clamping plate 262 may have any number of arc-shaped clamping plate segments 292, 294, 296.

Figure 8:
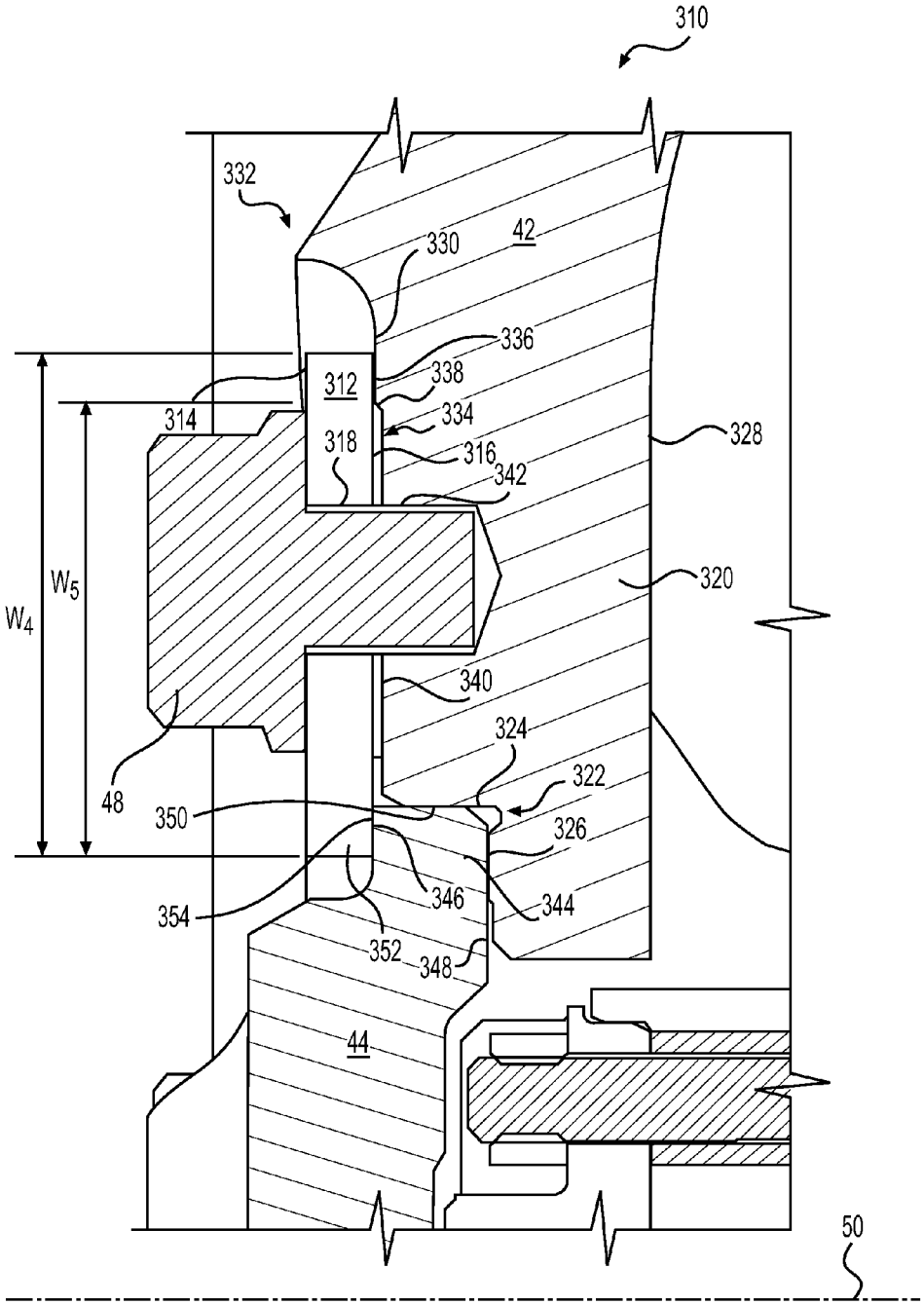
FIG. 8 is a cut-away view of an exemplary disclosed turbine housing assembly for the turbocharger of FIG. 1.

FIG. 8 illustrates a cut-away view of an exemplary embodiment of turbine housing assembly 310 for turbine stage 14 of turbocharger 10. Turbine housing assembly 310 includes one or more clamping plates 312 and one or more bolts 48 that cooperate to connect turbine housing 42 and bearing housing 44. Clamping plate 312 may abut on turbine housing 42 and bearing housing 44. In one exemplary embodiment, clamping plate 312 may be a single generally annular plate disposed around rotational axis 50. It is contemplated, however, that like clamping plate 262, clamping plate 312 may also have one or more segments similar to first clamping plate segment 292, second clamping plate segment 294, and third clamping plate segment 296. It is also contemplated that clamping plate 262 may have a first plurality of clamping plate segments and clamping plate 312 may have a second plurality of clamping plate segments. It is further contemplated that a number of clamping plate segments of clamping plate 262 may be the same as or different from a number of clamping plate segments of clamping plate 312. In addition, it is contemplated that clamping plate 312 may have a thickness, which may be the same as or different from a thickness of clamping plate 262. Clamping plate 312 may have a front face 314 and a rear face 316 disposed opposite to and axially spaced apart from front face 314. A plurality of holes 318 may be disposed on clamping plate 312. Holes 318 may be circumferentially spaced from each other. A circumferential spacing between holes 318 may be uniform or non-uniform. Holes 318 may be through holes that may extend from front face 314 to rear face 316. In some exemplary embodiments, holes 318 may have threads. Clamping plate 312 may have a radial width "$W_4$."

Turbine housing 42 may have a turbine housing wall 320. Turbine housing wall 320 may include a notch 322. Notch 322 may have a notch inner surface 324 and a notch rear wall 326. Notch inner surface 324 may have a generally cylindrical shape disposed around rotational axis 50. Notch rear wall 326 may extend radially inward from notch inner surface 324 and may be disposed generally orthogonal to rotational axis 50. Turbine housing wall 320 may also include turbine inner surface 328, which may enclose turbine wheel 34 (see FIG. 1). In addition, turbine housing wall may include clamping face 330 disposed opposite the turbine inner surface 328. Clamping face 330 may extend radially outward from notch inner surface 324 to turbine wall outer end 332.

Clamping face 330 of turbine housing wall 320 may include turbine flange recess 334 and turbine wall lip 336. Turbine flange recess 334 may extend axially inwards from clamping face 330 towards turbine inner surface 328 forming turbine wall lip 336. Turbine flange recess 334 may extend radially outward from notch inner surface 324 to recess outer edge 338 disposed between notch inner surface 324 and turbine wall outer end 332. Turbine flange recess 334 may have a radial width "$W_5$," which may be smaller than a radial width $W_4$ of clamping plate 312. In one exemplary embodiment radial width $W_5$ may range from about 70% to about 90% of width $W_4$. As illustrated in FIG. 8, turbine flange recess 334 may include a recess surface 340 axially spaced apart from clamping face 330 of turbine housing wall 320. In one exemplary embodiment, an axial spacing of recess surface 340 from clamping face 330 may range from about 0.8 mm to about 1.4 mm. Recess surface 340 may extend radially outward from notch inner surface 324 to recess outer edge 338. Turbine wall lip 336 may be disposed adjacent recess outer edge 338 of turbine flange recess 334. Turbine wall lip 336 may extend radially outward from recess outer edge 338 to turbine wall outer end 332. As also illustrated in FIG. 8, rear face 316 of clamping plate 312 may abut on turbine wall lip 336. Recess surface 340 of turbine housing wall 320 may include a plurality of holes 342. Like holes 318, holes 342 may be circumferentially spaced from each other. A circumferential spacing between holes 342 may be uniform or non-uniform. Holes 342 may be arranged so as to align with holes 318. Holes 342 may also be threaded.

Bearing housing 44 may include a bearing housing flange 344. Bearing housing flange 344 may have front face 346, rear face 348 disposed opposite front face 346, and bearing flange outer surface 350. Bearing housing flange 344 may abut on notch rear wall 326 of turbine housing wall 320 such that bearing flange outer surface 350 may be disposed adjacent to and may abut on notch inner surface 324. Clamping plate 312 may include an overhang portion 352, which may extend radially inward from holes 318. Overhang portion 352 may include a rear face portion 354 that may abut on front face 346 of bearing housing flange 344. As illustrated in FIG. 8, clamping face 330 of turbine housing wall 320 may be disposed generally coplanar with front face 346 of bearing housing flange 344.

Bolts 48 may pass through holes 318 and may be threadingly received in holes 342 to help connect clamping plate 312 with turbine housing wall 320 and bearing housing flange 344. In some exemplary embodiments, bolts 48 may be also threadingly received in holes 318. Although FIG. 8 illustrates bolts 48 being assembled with holes 318 and/or holes 342, it is contemplated that threaded studs (not shown) may be threadingly assembled into holes 342 and nuts (not shown) abutting on front face 314 of clamping plate 312 may be attached to the studs to connect clamping plate 312 to turbine housing wall 320. As illustrated in FIG. 8, clamping plate 312 may extend over turbine flange recess 334 and abut on turbine wall lip 336 on turbine housing 42 and front face 346 of bearing housing flange 344. Supporting clamping plate 312 at two radial locations in this manner may help minimize and/or eliminate bending loads transferred by clamping plate 312 on bolts 48. Further, clamping plate 312 may bend within turbine flange recess 334 when bolts 48 are turned, helping to generate tensile load in bolts 48. Tensile loading in bolts 48 may in turn help to firmly attach clamping plate 312 to turbine housing wall 320 and bearing housing flange 344.

INDUSTRIAL APPLICABILITY

The disclosed compressor assembly 90 may be implemented to help reduce or eliminate leakage of air through gaps between vane tips 178 of compressor diffuser ring 60 and inner wall 132 of compressor housing 40. Compressor assembly 90 may also be implemented to help improve an efficiency of compressor stage 12 by using shim 246 dimensionally matched to turbocharger cartridge 256 to help reduce or eliminate gaps between vane tips 178 and inner wall 132. Additionally, compressor assembly 90 may be implemented to reduce or eliminate failure of compressor blades induced by excitation of compressor blades 26 caused by pressure wakes generated by vanes 148 in diffuser ring 60. Further, compressor assembly 90 may be implemented to help ensure that compressor housing 40, bearing housing 44, and turbine housing 42 may be assembled without inducing bending loads on bolts 46, 48. The disclosed compressor assembly 90 may also be implemented help reduce wear on internal components of compressor assembly 90 caused by thermally induced relative movement between the components.

Referring to FIGS. 1 and 2, during operation of turbocharger 10, exhaust gases from the engine (not shown) may enter turbine housing 42 via turbine inlet 52, expand against turbine blades 38, rotating turbine wheel 34. Rotation of turbine wheel 34 may rotate shaft 18, which in turn may rotate compressor impeller 16. Air may enter compressor housing 40 via compressor inlet 56 and exit compressor housing 40 via compressor outlet 58. As air moves through compressor stage 12, the rotating compressor impeller 16 may accelerate the air. Air leaving outer edges 78 of compressor blades 26 may be decelerated as the air flows between vanes 148 of diffuser ring 60. Deceleration of air in diffuser ring 60 may increase a pressure of the air in volute 72 of compressor stage 12. Air compressed by the pressure generated in compressor stage 12 may be forced into the combustions chambers of the engine for combustion of fuel. Air flowing in gaps between inner wall 132 and vane tips 178 can bypass the deceleration induced by diffuser ring 60, reducing the ability of diffuser ring 60 to convert the kinetic energy of the air into pressure in volute 72. Reduced pressure in volute 72 may adversely affect performance of the engine.

Compressor assembly 90 may include numerous features that help to reduce or eliminate gaps between vane tips 178 and inner wall 132 of compressor housing 40. For example, compressor assembly 90 may include a wave spring 184 disposed between second web face 130 and back plate 146 of diffuser ring 60. Wave spring 184 may exert an axial force on back plate 146 forcing diffuser ring 60 to move towards compressor front end 62 and pushing vane tips 178 to firmly come into contact with inner wall 132 of compressor housing 40. By forcing vane tips 178 to firmly abut on inner wall 132, wave spring 184 may help reduce or eliminate gaps between vane tips 178 and inner wall 132 at all operating conditions of turbocharger 10. Wave spring 184 may also help reduce or eliminate damage caused to vanes 148 when the turbocharger is not operational by helping to urge vane tips 178 to come into contact with inner wall 132. Allowing vane tips 178 to remain in contact with inner wall 132 in this manner may help prevent excessive vibration of vanes 148, which in turn may help reduce or eliminate damage to vanes 148.

Furthermore, during operation of turbocharger 10, high pressure air from volute 72 may bleed through radial gap 168 into cavity 172. The high pressure air may help push back plate 146 away from second web face 130 toward compressor front end 62, which in turn may urge vane tips 178 to firmly come into contact with inner wall 132 of compressor housing 40. By forcing vane tips 178 to firmly abut on inner wall 132, bleed air in cavity 172 may help reduce or eliminate gaps between vane tips 178 and inner wall 132 during high pressure operation of compressor stage 12.

Radial gap 168 and seal member 170 may also help back plate 146 of diffuser ring 60 to freely expand thermally during operation of compressor stage 12. For example, diffuser ring 60 may be made of aluminum, aluminum alloy, or other alloys, which has a relatively high coefficient of thermal expansion compared to compressor housing 40 and bearing housing 44, both of which may be made of an iron alloy or other alloys. The radial gap 168 and the compressive nature of seal member 170 may allow back plate 146 to expand without coming into contact with or interfering with inner face 166 of volute rear wall 100 of bearing housing 44. Moreover, because seal member 170 is disposed on ledge outer surface 136, which is disposed generally orthogonal to wave spring 184, the axial force exerted by wave spring 184 may not diminish the compressive forces generated in seal member 170. As a result operation of wave spring 184 may not diminish the strength of the seal generated by seal member 170 between ledge outer surface 136 and bottom face 158 of back plate 146. Consequently, seal member 170 may be able to maintain a very effective seal, preventing recirculation of air from volute 72 through cavity 172 and into passageway 134 during the entire range of operation of turbocharger 10, helping to improve the efficiency of compressor stage 12.

Referring to FIGS. 1-4, compressor assembly 90 may also help reduce or eliminate gaps between vane tips 178 and inner wall 132 of compressor housing 40 by reducing the dimensional mismatch between compressor impeller 16, shaft 18, turbine wheel 34, compressor housing 40, turbine housing 42 and bearing housing 44. In particular, dimensions of turbocharger cartridge 256 may be measured after assembling compressor impeller 16, shaft 18, turbine wheel 34, turbine housing 42, and bearing housing 44. A maximum thickness $t_3$ of shim 246 may be selected based on the measured dimensions of turbocharger cartridge 256 and dimensional tolerances associated with compressor housing 40. In particular, an axial load may be applied to shaft 18, pushing compressor impeller 16 away from turbine housing 42 and towards compressor front end 62. An axial distance "A" between recess seating surface 124 and a gage location 258, on compressor impeller 16, may be measured. Gage location 258 may be a predetermined location on compressor impeller 16. Further, an axial distance "B" may be measured between rear face 118 of volute rear wall 100 and a gage location 259 on inner wall 132 of compressor housing 40. In addition, a variation of distance B may be determined based on known manufacturing tolerances. Additionally or alternatively, the variation may be determined based on measurements of distance B on a plurality of compressor housings 40. A maximum thickness $t_3$ may be determined based on distance A, distance B, and the variation of distance B, so that that vane tips 178 may remain in contact with inner wall 132 of compressor housing 40. For example, thickness $t_3$ may be selected so that a distance "C" between recess seating surface 124 of bearing housing flange 106 and gage location 259 may be greater than or equal to a sum of thickness $t_3$ and a maximum value of distance B determined based on the variation in distance B. Shim 246 with the selected thickness $t_3$ may be fixedly attached to bearing housing flange 106. Matching thickness $t_3$ of shim 246 to turbocharger cartridge 256 in this manner may help ensure that vane tips 178 may firmly abut on inner wall 132 of compressor housing 40 regardless of the dimensional tolerance variations expected in compressor housing 40. Thus, selecting a thickness $t_3$ for shim 246 matched to turbocharger cartridge 256 may help reduce or eliminate gaps between vane tips 178 and inner wall 132 of compressor housing 40.

Referring to FIG. 2, compressor assembly 90 may include vaneless space 200 extending from outer edges 78 of a rearmost row 32 of compressor blades 26 and vane leading edges 180. A radial extent $\Delta R$ of vaneless space 200 may be selected so that high frequency vibration of vanes 148 caused by pressure wakes generated at vane leading edges 180 may be reduced or eliminated. In particular, the radial extent $\Delta R$ may be selected to be at least 20% of a maximum radius $R_2$ of compressor blades 26 in rearmost row 32 of compressor impeller 16 to reduce or eliminate high frequency vibrations in compressor blades 26. A larger value of $\Delta R$ may be advantageously selected to further reduce the effect of pressure wakes generated at vane leading edges 180 on compressor blades 26. To minimize an overall volume of compressor stage 12, however, radial extent $\Delta R$ may be selected to range from about 20% to 40% of radius $R_2$. Selecting the radial extent of vaneless space 200 in this manner may help to reduce or eliminate fatigue failures of compressor blades 26 caused by vibrations induced in compressor blades 26 by pressure wakes generated at vane leading edges 180. Reducing or eliminating the fatigue failures of compressor blades 26 may help extend a useful life of compressor assembly 90.

Referring to FIGS. 3 and 4, tabs 226 may help to prevent rotation of diffuser ring 60 relative to rotational axis 50. Further, washers 244 and fasteners 242 may help attach diffuser ring 60 to volute rear wall 100 of compressor housing 40. Depths of recesses 220 and 239 may be selected so as to maintain an axial gap 234 between tab front face 228 and recess rear face 222 of volute rear wall 100. Axial gaps 234 and radial gaps 236 between tab side surface 232 and recess side surface 224 of recess 220 may help ensure that diffuser ring 60 and tabs 226 may freely expand relative to compressor housing 40 without significantly wearing out tab front face 228, tab rear face 230, and tab side surface 232 during operation of turbocharger 10. In some exemplary embodiments, tabs 226 and diffuser ring 60 may be made out of aluminum, aluminum alloy, or other alloys, which may have a relatively high coefficient of thermal expansion relative to compressor housing 40, which may be made of an iron alloy or other alloys. During operation of turbocharger 10, a temperature of diffuser ring 60 and compressor housing 40 may increase. Diffuser ring 60 and tabs 226 may expand radially and axially to a much larger extent than volute rear wall 100 of compressor housing 40. Thus, tabs 226 may move radially and axially relative to compressor housing 40 numerous times. For example, in one exemplary embodiment, tabs 226 may move radially and axially relative to compressor housing 40 many thousands of times during operation of turbocharger 10. Radial gap 236 may allow tabs 226 to expand freely without interfering with recess side surface 224. Further, axial gap 234 may allow tabs 226 to move relative to recess rear face 222 without causing excessive wear of tabs 226. Thus, tabs 226 may allow diffuser ring 60 to be firmly attached to compressor housing 40, while still allowing relative movement between tabs 226 and recess rear face 222 of recess 220 in volute rear wall 100 caused by differential thermal expansion of diffuser ring 60 and compressor housing 40.

Additionally, when turbocharger 10 with four tabs 226 is mounted on a horizontal surface with the gravitational direction being generally orthogonal to the horizontal surface, first and second diametrical axes 237 and 238 may be positioned symmetrically about the gravitational direction. Positioning first and second diametrical axes 237, 238 in this manner may allow an entire weight of turbocharger 10 to be about equally distributed on each of the four tabs 226. Furthermore, such an arrangement may also allow additional radial loads generated by the operation of turbocharger 10 to be distributed about equally between the four tabs 226.

Referring to FIG. 6, compressor housing assembly 260 may help ensure that bolts 46 are not subjected to bending loads when used to assemble compressor housing 40 and bearing housing 44. As illustrated in FIG. 6, clamping plate 262 may be supported at radial locations by compressor flange lip 280 and flange rear face 114 of bearing housing flange 106. Clamping plate 262 may span compressor flange recess 278. Supporting clamping plate 262 at radially separated locations may allow clamping plate 262 to maintain compressor housing 40 and bearing housing 44 in an assembled configuration even when compressor housing 40 and bearing housing 44 undergo different amounts of axial thermal expansion. Supporting clamping plate 262 on compressor flange lip 280 and bearing housing flange 106 may also allow clamping plate 262 to bend into compressor flange recess 278 as bolts 46 are turned. Bending of clamping plate 262 may help ensure tensile load is generated along a longitudinal axis of bolts 46 while reducing bending loads on bolts 46. Moreover, the tensile load generated in bolts 46 because of bending of clamping plate 262 may help maintain assembly of compressor housing 40 with bearing housing 44 even if bolts become loose during operation of turbocharger 10. Furthermore, because clamping plate 262 applies an axial load to maintain assembly of compressor housing 40 and bearing housing 44, clamping plate 262 may allow compressor flange lip 280 and bearing housing flange 106 to undergo different amounts of radial expansion while still maintaining a clamping load induced by bolts 46.

Referring to FIG. 8, turbine housing assembly 310 may help ensure that bolts 48 are not subjected to bending loads when used to assemble turbine housing 42 and bearing housing 44. As illustrated in FIG. 8, clamping plate 312 may be supported at radial locations by turbine wall lip 336 and bearing housing flange 344. Clamping plate 312 may span turbine flange recess 334. Supporting clamping plate 312 at radially separated locations may allow clamping plate 312 to maintain turbine housing 42 and bearing housing 44 in an assembled configuration even when turbine housing 42 and bearing housing 44 undergo different amounts of axial thermal expansion. Supporting clamping plate 312 on turbine wall lip 336 and bearing housing flange 344 may also allow clamping plate 312 to bend into turbine flange recess 334 as bolts 48 are turned. Bending of clamping plate 312 may help ensure tensile load is generated along a longitudinal axis of bolts 48 while reducing bending loads on bolts 48. Moreover, the tensile load generated in bolts 48 because of bending of clamping plate 312 may help maintain assembly of turbine housing 42 with bearing housing 44 even if bolts become loose during operation of turbocharger 10. Furthermore, because clamping plate 312 applies an axial load to maintain assembly of turbine housing 42 and bearing housing 44, clamping plate 312 may allow turbine wall lip 336 and bearing housing flange 344 to undergo different amounts of radial expansion while still maintaining a clamping load induced by bolts 48.

It will be apparent to those skilled in the art that various modifications and variations can be made to the disclosed compressor assembly. Other embodiments will be apparent to those skilled in the art from consideration of the specification and practice of the disclosed compressor assembly. It is intended that the specification and examples be considered as exemplary only, with a true scope being indicated by the following claims and their equivalents.

What is claimed is:

1. A compressor assembly, comprising:

a compressor housing having a recess, the recess including a recess rear face;

a compressor impeller disposed within the compressor housing;

a bearing housing attached to the compressor housing;

a diffuser ring disposed between the compressor housing and the bearing housing, the diffuser ring including an inner bore that is larger in a radial direction relative to the bearing housing such that a radial gap is formed between the bearing housing and the diffuser ring;

at least one tab extending radially outward from the diffuser ring, the at least one tab having a tab front face and being configured to engage with the recess in the compressor housing such that the tab front face is disposed adjacent the recess rear face and separated therefrom by an axial gap;

at least one fastener configured to attach the diffuser ring and the compressor housing;

a seal number disposed in sealing relation in the radial gap between the diffuser ring and the bearing housing; and a wave spring disposed in an axial direction between the diffuser ring and the bearing housing.

2. The compressor assembly of claim 1, wherein the bearing housing includes a bearing housing flange, the compressor housing includes a volute having a volute rear wall, and the at least one tab is disposed between the bearing housing flange and the volute rear wall.

3. The compressor assembly of claim 2, wherein the recess is disposed in the volute rear wall, the recess rear face is disposed generally orthogonal to a rotational axis of the compressor assembly; and a recess side surface extending axially from the recess rear face to a rear surface of the volute rear wall, wherein the at least one tab is radially separated from the recess side surface by a gap.

4. The compressor assembly of claim 3, wherein the tab side surface is radially separated from the recess side surface.

5. The compressor assembly of claim 1, further including a plurality of tabs disposed circumferentially the diffuser ring, wherein the at least one tab is one of the plurality of tabs.

6. The compressor assembly of claim 5, wherein a first tab of the plurality of tabs is disposed about a first diametrical axis, and a second tab of the plurality of tabs is disposed about a second diametrical axis disposed at an angle relative to the first diametrical axis.

7. The compressor assembly of claim 6, wherein the first diametrical axis is disposed orthogonal to the second diametrical axis.

8. The compressor assembly of claim 7, wherein a circumferential spacing between the tabs is non-uniform.

9. The compressor assembly of claim 7, wherein a number of the tabs is 4.

10. A turbocharger, comprising:

a turbine housing;

a turbine wheel disposed within the turbine housing and configured to be driven by exhaust received from an engine;

a compressor housing having a recess, the recess including a recess rear face;

a compressor impeller disposed within the compressor housing;

a shaft connecting the turbine wheel and the compressor impeller;

a bearing housing attached to the compressor housing and the turbine housing;

a diffuser ring disposed between the compressor housing and the bearing housing, the diffuser ring including an inner bore that is larger in a radial direction relative to the bearing housing such that a radial gap is formed between the bearing housing and the diffuser ring;

at least one tab extending radially outward from the diffuser ring, the at least one tab having a tab front face and being configured to engage with the recess in the compressor housing such that the tab front face is disposed adjacent the recess rear face and separated therefrom by an axial gap;

at least one washer abutting on the bearing housing and the diffuser ring;

a seal member disposed in sealing relation in the radial gap between the diffuser ring and the bearing housing;

a wave spring disposed in an axial direction between the diffuser ring and the bearing housing; and at least one fastener configured to pass through the at least one washer and attach the diffuser ring and the compressor housing.

11. The turbocharger of claim 10, further including a plurality of tabs disposed circumferentially spaced apart on the diffuser ring, wherein the at least one tab is one of the plurality of tabs.

12. The turbocharger of claim 11, wherein a first tab of the plurality of tabs is disposed along a first diametrical axis, and a second tab of the plurality of tabs is disposed along a second diametrical axis disposed at an angle relative to the first diametrical axis.

* * * * *